United States Patent [19]

Siegel

[11] Patent Number: 4,754,626

[45] Date of Patent: Jul. 5, 1988

[54] SHACKLELESS LOCK PROTECTOR

[76] Inventor: Myron Siegel, 29 Lexington Ave., Brooklyn, N.Y. 11238

[21] Appl. No.: 44,578

[22] Filed: May 1, 1987

[51] Int. Cl.[4] ..... E05B 67/36

[52] U.S. Cl. ..... 70/32; 70/51

[58] Field of Search ..... 70/32, 33, 34, 23, 14, 70/51

[56] References Cited

U.S. PATENT DOCUMENTS 3,817,062 6/1974 Randel ..... 70/32

3,995,459 12/1976 Weeks ..... 70/34

4,030,321 6/1977 Kenyon ..... 70/34

*Primary Examiner*—Robert L. Wolfe

*Attorney, Agent, or Firm*—Richard L. Miller

[57] ABSTRACT

This lock protector is designed to be received over a padlock strap and staple combination used to lock a door. Primarily, it consists of an elongated block or bar having an opening for receiving the padlock staple, and a larger opening in a face of the block receives a flat cylindrical lock member that also receives the padlock staple and locks the door by the employment of a key to advance the lock member bolt through the staple.

1 Claim, 1 Drawing Sheet

SHACKLELESS LOCK PROTECTOR

BACKGROUND OF THE INVENTION

The instant invention relates generally to lock devices, and more particularly, to a shackleless lock protector.

Numerous lock devices have been provided in the prior art that are adapted to protect against unlawful entry . For example, U.S. Pat. No. 3,769,821 is illustrative of such prior art. While this unit may be suitable for the particular purpose to which it addresses, it alone would not be as suitable for the purpose of the present invention as hereafter described.

SUMMARY OF THE INVENTION

A primary object of the present invention is to provide a shackleless lock protector that will overcome the shortcomings of the prior art devices.

Another object is to provide a shackleless lock protector, which will be designed to be received on a hasp strap and staple, instead of a padlock, for increase protection against unlawful entry.

An additional object is to provide a skackless lock protector, which will include a cylindrical lock portion that cooperates with a recessed bar or block to cover a hasp staple.

A further object is to provide a shackleless lock protector that is simple and easy to use.

A still further object is to provide a shackleless lock protector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 3:
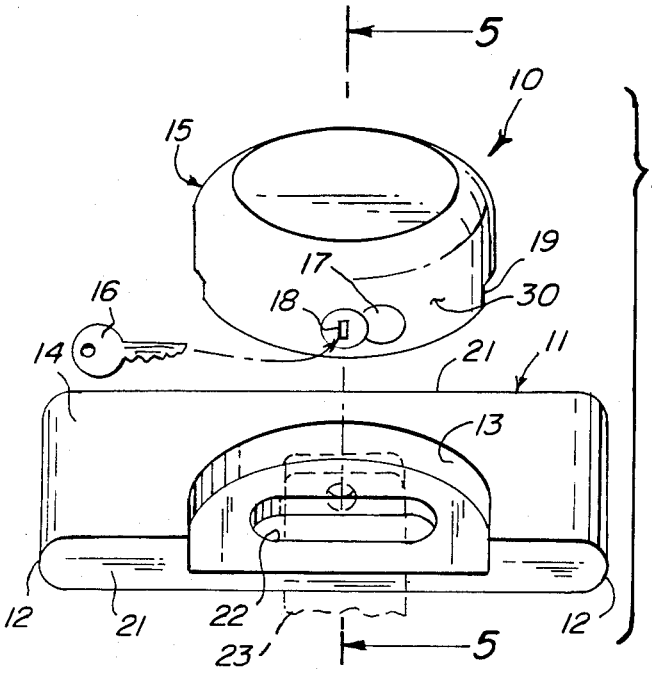

FIG. 3 is an exploded perspective view of the invention cooperating with a lock similar to the type described in U.S. Pat. No. 3,769,821.

Figure 4:
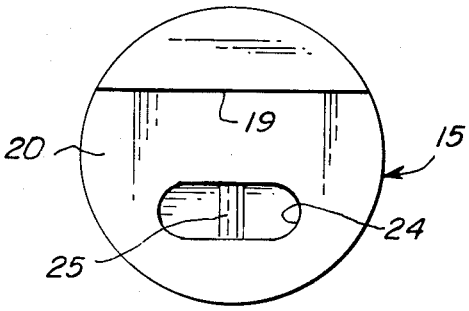

FIG. 4 is a bottom view showing relevant details of the lock per se similar to the type described in U.S. Pat. No. 3,769,821.

Figure 1:
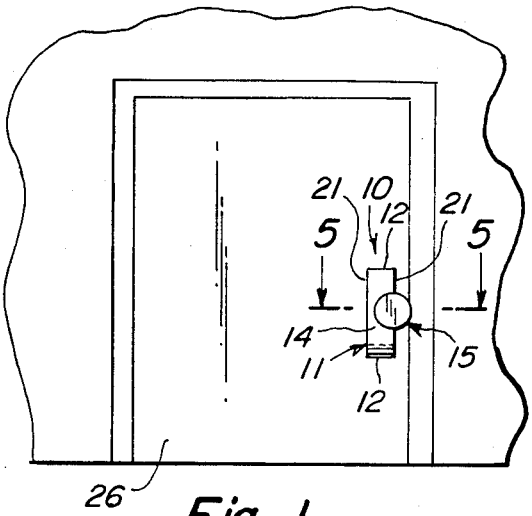
FIG. 1 is a front elevational view of the invention installed on a door.
Figure 2:
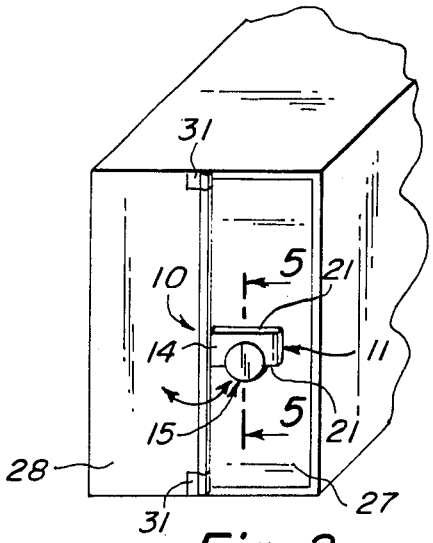
FIG. 2 is a perspective view of the invention installed on the rear of a truck.
Figure 5:
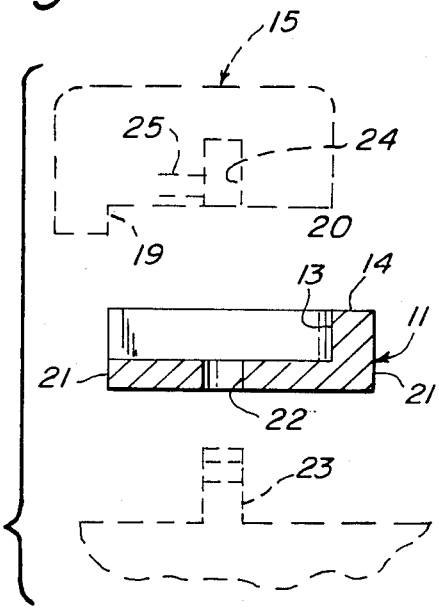

FIG. 5 is a cross sectional view as indicated by line 5—5 in FIGS. 1, 2 and 3 of the invention with lock and hasp shown in phantom.

DETAILED DESCRIPTION OF THE PREFERRED EMBODIMENTS

Turning now descriptively to the drawings, in which like reference characters denote like elements throughout the several views, FIG. 1 illustrates lock protector 10 that includes a rectangular configurated block 11 with rounded ends 12. A recessed and arcuate cut-out opening 13 is provided in the front face 14 of block 11, for removably receiving a flat and cylindrical lock member 15 that in this instance is key 16 operated. A locking mechanism 17 is provided in lock member 15 and an opening 18 therein, receives the key 16. The outer peripheral surface 30 of lock member 15 is designed to engage with the arcuate surface of the cut-out opening 13 provided in block 11, when lock protector 10 is in use, and a shoulder 19 integrally attached and projecting from the rear face 20 of lock member 15, is designed to engage with one longitudinal side 21 of block 11, so as to properly position lock member 15 when engaged with the block 11.

An elongated cut-out opening 22 is provided through block 11 in the center portion of the cut out opening 13, for removably receiving a conventional hasp staple 23 that is received through a padlock shackle(not shown), and a recessed opening 24 is provided in the rear face of lock member 15, for receiving the padlock shackle 23 that removably receives the reciprocal bolt 25 of lock member 15.

It shall be noted, that the shoulder 19 of lock member 15 provides for the necessary alignment of lock member 15, enabling opening 22 to align with opening 24 in lock member 15, for the lock bolt 25 to be received in the hasp staple 23.

In use, the hinged hasp strap (not illustrated) is first engaged over the hasp staple 23, after which the opening 22 of block 11 is aligned with the staple and block 11 is urged towards the door 26. When the above has been accomplished, the lock member 15 is placed in the cut-out opening 13 of block 11 and the shoulder 19 of lock member 15 is engaged with a longitudinal side 21 for proper alignment. After the above, the key 16 is employed in the opening 18 and is rotated, which causes the lock bolt 25 to enter the staple 23 and prevents the door 26 from being opened until the key 16 is again inserted for removal of lock protector 10 from the staple 23. It is to be noted that the lock protector may be welded or other wise suitably permanently secured to the door if the user wishes to make unauthorized entry more difficult.

Referring now to FIG. 2 of the drawing, lock protector 10 is shown applied to a hinged cargo door 27 of a truck body 28. In this case the lock protector has been incorporated directly into the handle which operates latching mechanism 31 of the cargo door.

In use, the function is the same as heretofore described.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shackleless lock protector, comprising, an elongated block, for being received on a hasp strap and a hasp staple that cooperate with each other for locking a door, and a cylindrical disc-type lock member received in said block, for retaining said block on said hasp strap and said staple and preventing unauthorized entry through said door, wherein said block is provided with an arcuate opening through a front face and matingly receives an outer peripheral surface of said lock member, and a shoulder is integrally attached to a rear face of said lock member, projects outward and engages with a longitudinal side of said block, so as to properly position the lock member on the block, wherein the arcuate opening through said front face of said block extends through a second longitudinal side of said block, and a longitudinal second opening is provided through said block within the confines of the arcuate opening and freely receives said hasp staple, and a key operable bolt of a locking mechanism within said lock member is removably received through said hasp staple, and wherein said bolt traverses an elongated opening provided in said lock member and said staple is freely received within the elongated opening in the lock member.

* * * * *